US009908755B2

(12) United States Patent
Hoffend, III

(10) Patent No.: US 9,908,755 B2
(45) Date of Patent: Mar. 6, 2018

(54) LIFT ASSEMBLY WITH LOAD CELLS

(71) Applicant: Electronic Theatre Controls, Inc., Middleton, WI (US)

(72) Inventor: Donald A. Hoffend, III, Annandale, VA (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 15/033,804

(22) PCT Filed: Nov. 20, 2014

(86) PCT No.: PCT/US2014/066573

§ 371 (c)(1),
(2) Date: May 2, 2016

(87) PCT Pub. No.: WO2015/077431

PCT Pub. Date: May 28, 2015

(65) Prior Publication Data

US 2016/0368744 A1 Dec. 22, 2016

Related U.S. Application Data

(60) Provisional application No. 61/907,786, filed on Nov. 22, 2013.

(51) Int. Cl.

| | |
|---|---|
| ***B66D 1/39*** | (2006.01) |
| ***A63J 1/02*** | (2006.01) |
| ***B66D 1/30*** | (2006.01) |

(52) U.S. Cl.
CPC *B66D 1/39* (2013.01); *A63J 1/02* (2013.01); *B66D 1/30* (2013.01)

(58) Field of Classification Search
CPC ..... B66D 1/30; B66D 1/36; B66D 1/39; A63J 1/02; A63J 1/028

(Continued)

(56) References Cited

U.S. PATENT DOCUMENTS 3,456,899 A * 7/1969 Burch ..... B66D 1/39 242/484
4,324,386 A * 4/1982 Gagnon ..... B66D 1/39 254/288

(Continued)

FOREIGN PATENT DOCUMENTS

DE 10117466 10/2002
JP H0632589 2/1994

(Continued)

OTHER PUBLICATIONS

International Search Report for Application No. PCT/US2014/066573 dated Jun. 12, 2015 (7 pages).

(Continued)

*Primary Examiner* — Michael E Gallion
(74) *Attorney, Agent, or Firm* — Michael Best & Friedrich LLP

(57) ABSTRACT

A lift assembly comprises a base, a drive mechanism, first and second flexible drive elements driven by the drive mechanism, first and second sheaves directing the first and second drive elements in different directions, and first and second load cells sensing load on the first and second sheaves. The sheaves can be mounted to first and second sheave mounts, and the load cells can sense load on the first and second sheave mounts. The sheave mounts can be provided on first and second sheave plates, and bearings can be positioned under the first and second sheave plates. The lift assembly can further comprise first and second sheave brackets for coupling the first and second sheaves to the first and second sheave mounts. The first sheave plate can further include an opening, and at least a portion of the second sheave bracket can be positioned in the opening.

18 Claims, 17 Drawing Sheets

(58) Field of Classification Search
USPC ..... 254/394
See application file for complete search history.

(56) References Cited

U.S. PATENT DOCUMENTS

| | | | | |
|---|---|---|---|---|
| 4,334,670 | A * | 6/1982 | Kawabe | B66D 1/38 242/397.3 |
| 4,492,363 | A * | 1/1985 | Niskin | B66D 1/36 254/275 |
| 4,606,527 | A * | 8/1986 | Ziller | A63J 1/028 254/336 |
| 5,106,057 | A * | 4/1992 | Feller | B66D 1/26 254/283 |
| 5,361,565 | A * | 11/1994 | Bayer | A63J 1/028 254/270 |
| 6,520,485 | B1 * | 2/2003 | Soot | B66D 1/39 160/331 |
| 6,634,622 | B1 * | 10/2003 | Hoffend, Jr. | A63J 1/028 254/331 |
| 7,243,870 | B2 * | 7/2007 | Pook | A63J 1/028 242/278 |
| 7,293,762 | B2 * | 11/2007 | Hoffend, Jr. | A63J 1/028 254/331 |
| 7,484,712 | B2 * | 2/2009 | Hossler | A63J 1/028 254/331 |
| 7,562,863 | B2 * | 7/2009 | Kochan | A63J 1/028 242/602.1 |
| 7,766,308 | B2 * | 8/2010 | Kochan | A63J 1/028 242/602.1 |
| 7,854,423 | B2 * | 12/2010 | Hoffend, Jr. | A63J 1/028 254/331 |
| 8,596,616 | B1 * | 12/2013 | Soot | A63J 1/028 254/334 |
| 8,613,428 | B2 * | 12/2013 | Hoffend, III | A63J 1/028 254/286 |
| 8,636,265 | B1 * | 1/2014 | Soot | A63J 1/028 254/334 |
| 8,684,336 | B1 * | 4/2014 | Akerman | E21B 17/07 254/337 |
| 9,242,186 | B2 * | 1/2016 | Hoffend, III | A63J 1/028 |
| 9,260,279 | B2 * | 2/2016 | Hoffend, III | A63J 1/02 |
| 9,340,396 | B2 * | 5/2016 | Hoffend, III | A63J 1/028 |
| 2004/0099852 | A1 * | 5/2004 | Hoffend, Jr. | A63J 1/028 254/331 |
| 2006/0163548 | A1 * | 7/2006 | Kochan | A63J 1/028 254/278 |
| 2009/0127527 | A1 * | 5/2009 | Hoffend, III | A63J 1/028 254/338 |
| 2014/0319308 | A1 * | 10/2014 | Agazzi | B66C 23/88 248/542 |
| 2015/0008381 | A1 * | 1/2015 | Hausladen | B66D 1/30 254/288 |
| 2015/0144851 | A1 * | 5/2015 | Hoffend, III | A63J 1/028 254/278 |
| 2015/0144852 | A1 * | 5/2015 | Hoffend, III | A63J 1/02 254/316 |
| 2016/0184731 | A1 * | 6/2016 | Love | A63J 1/02 472/75 |
| 2016/0368744 | A1 * | 12/2016 | Hoffend, III | A63J 1/02 |

FOREIGN PATENT DOCUMENTS

| | | |
|---|---|---|
| KR | 20090115645 | 11/2009 |
| KR | 101219123 | 1/2013 |
| WO | 2011133993 | 11/2011 |

OTHER PUBLICATIONS

Written Opinion for Application No. PCT/US2014/066573 dated Jun. 12, 2015 (9 pages).

* cited by examiner

LIFT ASSEMBLY WITH LOAD CELLS

CROSS-REFERENCE TO RELATED APPLICATIONS

This application is a national stage filing under 35 U.S.C. § 371 of International Application No. PCT/US2014/066573, filed Nov. 20, 2014, which claims priority to U.S. Provisional Patent Application No. 61/907,786, filed Nov. 22, 2013, the entire contents of which are incorporated by reference herein.

BACKGROUND

The present invention relates generally to lift assemblies, such as those used to raise and lower scenery, props, and lighting on a stage.

Performance venues such as theaters, arenas, concert halls, auditoriums, schools, clubs, convention centers, and television studios can employ battens or trusses to suspend, elevate, and/or lower lighting, scenery, draperies, and other equipment that can be moved relative to a stage or floor. These battens are often raised or lowered by lift systems.

Conventional lift systems commonly include an overhead pulley, or loft block, supported by an overhead building support. Ropes or cables extend from the batten and through the loft blocks to a drive mechanism that facilitates movement of the cables. Such drive mechanisms often include a motor-driven drum that winds and unwinds the cables.

In order to insure that the lift system does not exceed capacity, some lift systems include means for measuring the load on the system. In the event that the load is exceeded, the motor can be deactivated or a warning can be generated.

SUMMARY

The present invention provides a lift assembly comprising a base, a drive mechanism, first and second flexible drive elements driven by the drive mechanism, first and second sheaves directing the first and second drive elements in different directions, and first and second load cells sensing load on the first and second sheaves, respectively. In one embodiment, the first and second sheaves are mounted to first and second sheave mounts (e.g., movable relative to the base), and the first and second load cells sense load on the first and second sheave mounts. The first and second sheave mounts can be provided on first and second sheave plates, and first and second bearings can be positioned under the first and second sheave plates. Side bearings can also be positioned between the sheave plates and the base.

Preferably, the first sheave plate is positioned at least partially directly below the second sheave plate. In this embodiment, the lift assembly can further comprise first and second sheave brackets for coupling the first and second sheaves to the first and second sheave mounts. The first sheave plate can further include an opening, and at least a portion of the second sheave bracket can be positioned in the opening.

The first sheave plate can further include an unused sheave mount adjacent the opening and substantially below the second sheave mount. The unused sheave mount is configured to allow mounting of the second sheave to the first sheave plate to thereby facilitate changing the direction of the second flexible element. Furthermore, the second sheave plate can include an unused sheave mount directly above the first sheave mount. This unused sheave mount is configured to allow mounting of the first sheave to the second sheave plate to thereby facilitate changing the direction of the first flexible element.

In another aspect, the present invention provides a lift assembly comprising a base, a drive mechanism, a flexible drive element driven by the drive mechanism and extending from the drive mechanism along a fleet axis, and a sheave directing the drive element from the fleet axis to an output axis different than the fleet axis. The sheave is coupled to the base at a first sheave mount aligned with the fleet axis. For example, the sheave can be coupled to the sheave mount by a sheave bracket that positions the sheave with an edge of the sheave aligned with the fleet axis.

In one embodiment, the base further includes a second sheave mount aligned with the fleet axis. The second sheave mount is configured to be coupled to the sheave to thereby allow the sheave to be de-coupled from the first sheave mount and coupled to the second sheave mount. The second sheave mount is positioned such that coupling of the sheave to the second sheave mount results in substantially no change in a fleet angle of the fleet axis.

In one embodiment, the sheave is positioned on a first side of the fleet axis when coupled to the first sheave mount, and the sheave is positioned on a second side of the fleet axis when coupled to the second sheave mount, the second side being substantially opposed to the first side. Preferably, the fleet axis substantially bisects the first and second sheave mounts.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
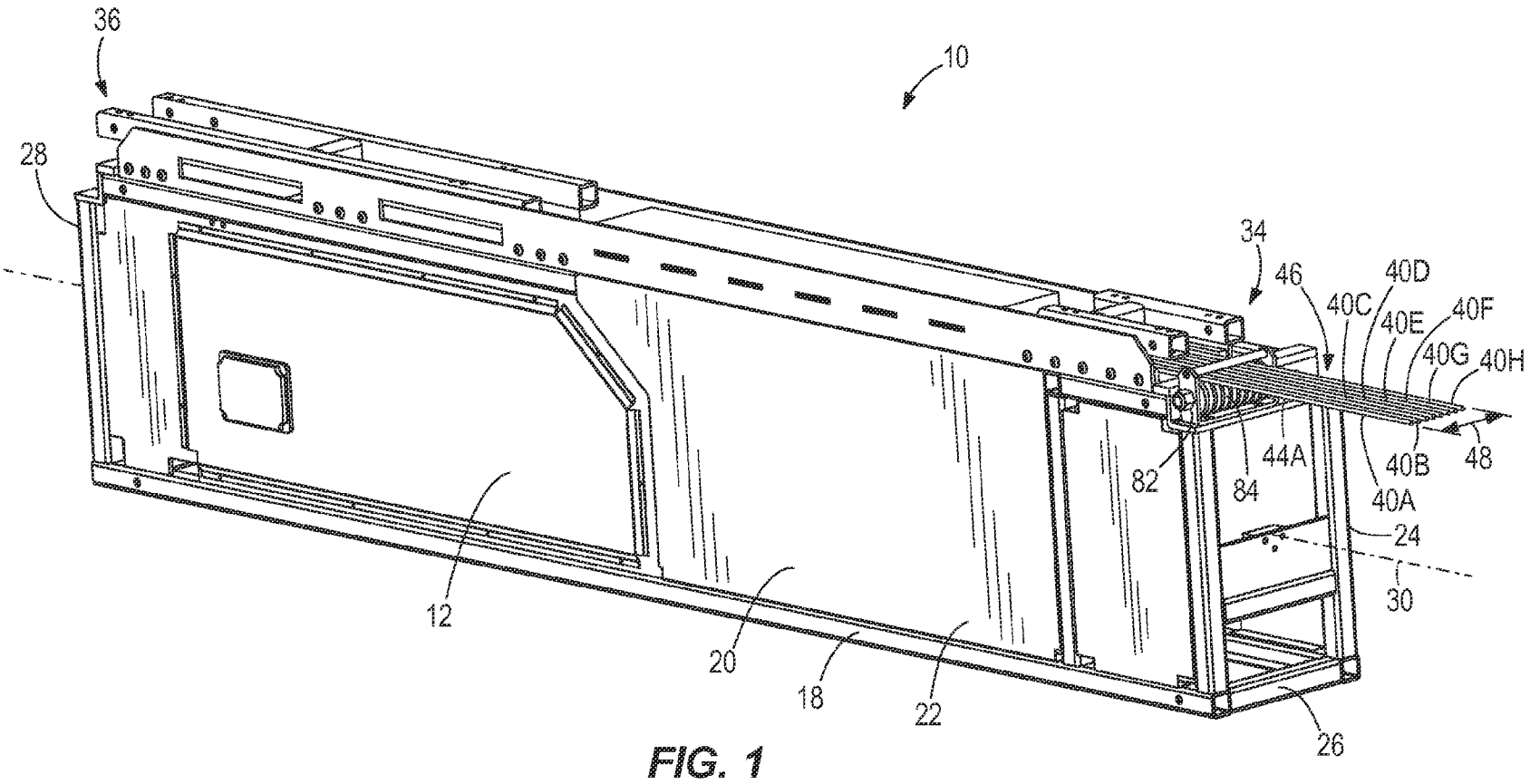
FIG. 1 is a perspective view of a lift assembly according to one embodiment of the invention.
Figure 2:
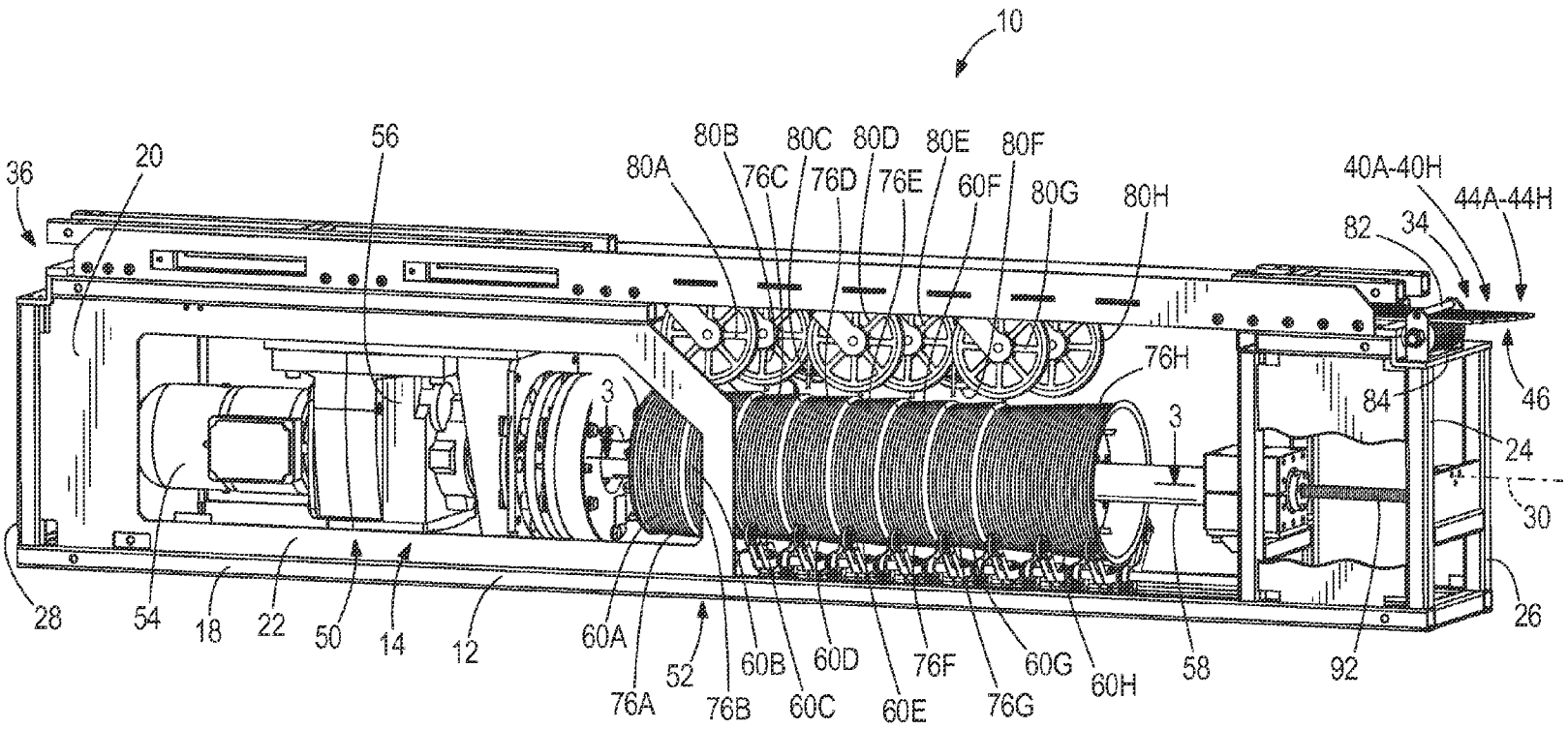
FIG. 2 is an alternative perspective view of the lift assembly of FIG. 1 with side panels of the lift assembly removed.

FIGS. 1-2 illustrate a lift assembly 10 including a base 12 and a take-up mechanism 14 that is mounted to the base 12. The base 12 includes a frame 18 and side panels 20 that are secured to the frame 18. The frame 18 provides a stable location for mounting the various internal components of the assembly 10, and the panels 20 provide a barrier for inhibiting contamination of and unauthorized access to the internal components and the panels 20 can also be sound deadening panels.

The base 12 further includes a first side 22, a second side 24, a first end 26, and a second end 28 that are defined by the frame 18 and the panels 20. The first side 22 and the second side 24 are parallel and face opposite directions and the first end 26 and the second end 28 are parallel and face opposite directions. The first and second sides 22, 24 extend along the length of the assembly 10 and a longitudinal axis or centerline 30 of the assembly 10 extends midway between the sides 22, 24 and bisecting the ends 26, 28. A length or longitudinal extent of the assembly 10 is the distance from the first end 26 to the second end 28 along the axis 30.

The base 12 further includes a first outlet 34 and a second outlet 36, the purpose of which will be discussed in more detail below. The first outlet 34 is located through the first end 26 of the base 12 and is positioned closer to the first side 22 than to the second side 24. Alternatively stated, the first outlet 34 is offset from the centerline 30 toward the first side 22 of the base 12. The second outlet 36 is located through the second end 28 of the base 12 and is positioned closer to the first side 22 of the base 12 than the second side 24. Similar to the first outlet 34, the second outlet 36 is offset from the centerline 30 toward the first side 22 of the base 12.

Figure 3:
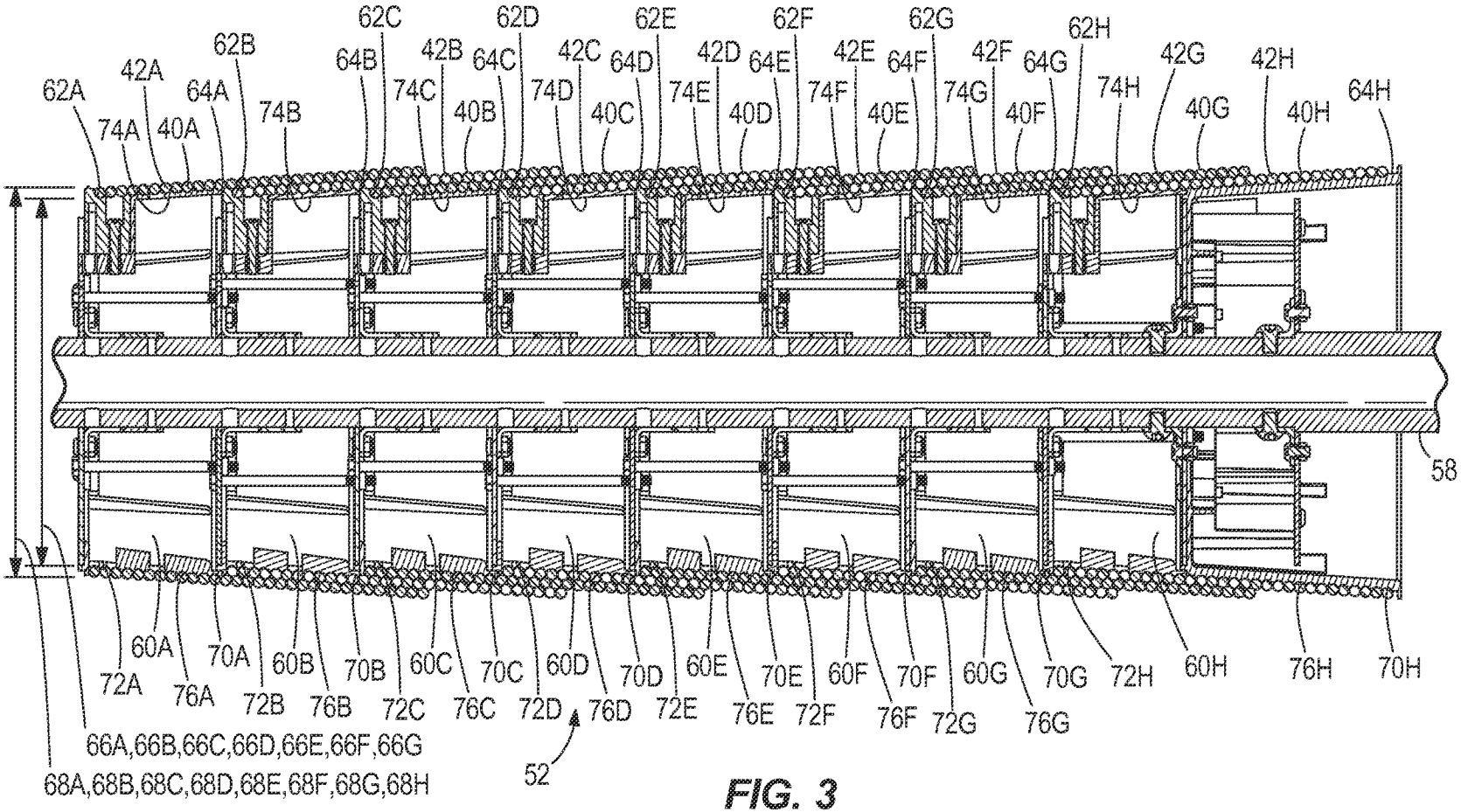
FIG. 3 is a cross-sectional view of a portion of the lift assembly of FIG. 1 taken along lines 3-3 of FIG. 2.

Referring to FIGS. 1 and 3, the lift assembly 10 further includes flexible drive elements 40A-40H. Each of the flexible drive elements 40A-40H is essentially the same (the only difference being their respective length), and only one flexible drive element 40A will be described in detail. Like portions of the drive elements 40A-40H have been give the same reference number with the suffix A-H, respectively. The flexible drive element 40A includes a stored portion 42A that is on the take-up mechanism 14 and a free portion 44A that extends from the take-up mechanism 14 through the outlet 34. The free portion 44A that extends through the outlet 34 is closer to the first side 22 of the base 12 than to the second side 24. That is, the free portion 44A is offset from the centerline 30 of the base 12 is a direction toward the first side 22. Together the flexible drive elements 40A-40H extend through the outlet 34 to define a cable path 46 having a cable path width 48 (see FIG. 4). The cable path 46 is offset from the centerline 30 of the base 12 in a direction toward the first side 22. In the illustrated embodiment, the entire cable path 46 (i.e., all of the flexible drive elements 40A-40H) exiting the outlet 34 is located between the first side 22 and the centerline 30. In other embodiments, a portion of the cable path 46 can be on the other side of the centerline 30 (i.e., between the centerline 30 and the second side 24). Also, in the illustrated embodiment, all of the flexible drive elements 40A-40H in the cable path are flush in a direction perpendicular to the cable path 46, such that the cable path 46 is flat and the flexible drive elements 40A-40H are co-planar. In the illustrated embodiment, the flexible drive elements 40A-40H are cables, such as a twisted wire cables with multiple strands, but in other embodiment, other suitable flexible drive elements may be utilized, such as, chains, ropes, and the like.

Figure 5:
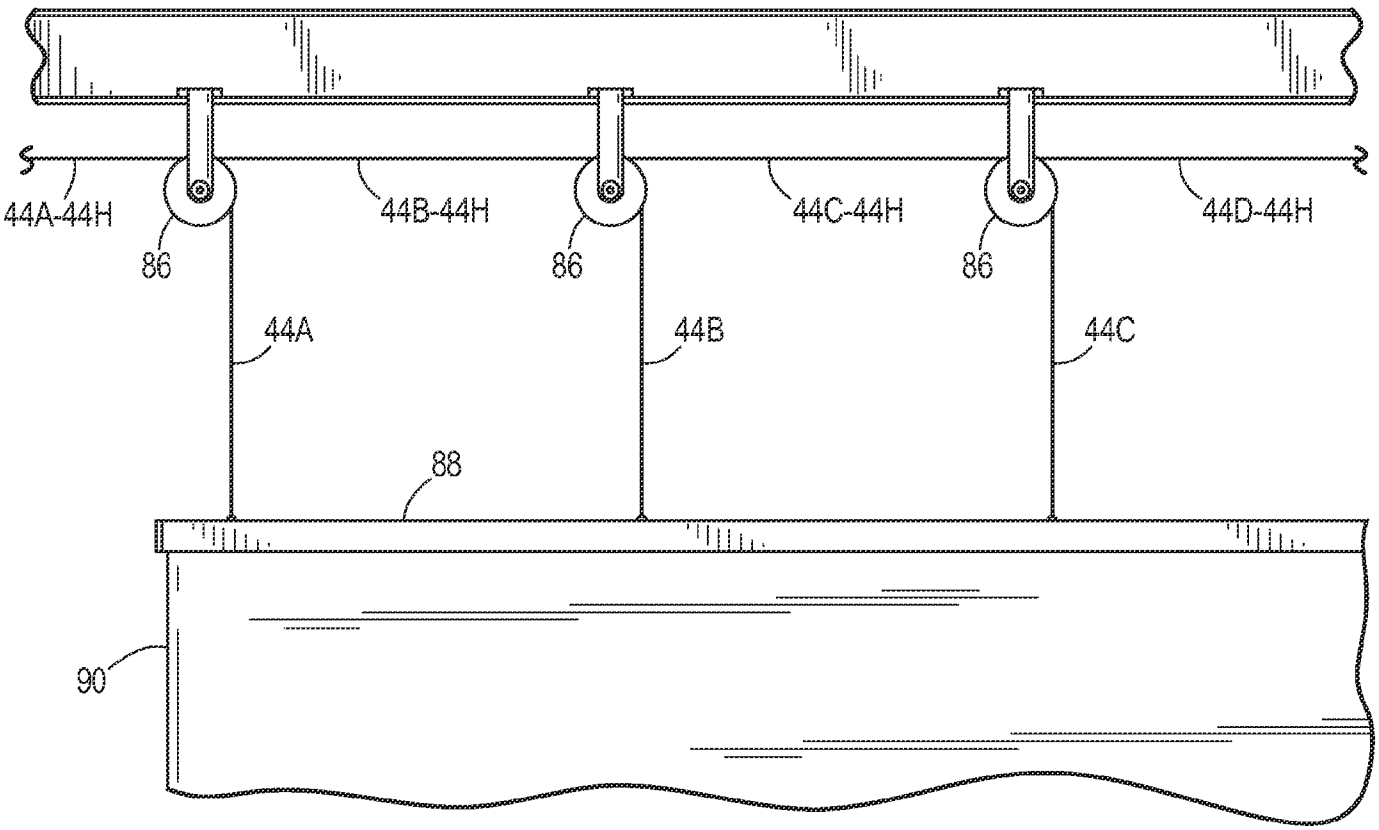
FIG. 5 illustrates one application of the lift assembly of FIG. 1.

As illustrated in FIG. 5, in one application of the lift assembly 10, the free portions 44A-44H of the flexible drive elements 40A-40H are routed to loft blocks 86 that change the direction of the flexible drive elements 40A-40H and then routed to a batten 88 or the like to raise and lower an article 90 such as scenery, props, and lighting on a stage.

Referring to FIG. 2, the take-up mechanism 14 includes a drive mechanism 50 and a drum assembly 52. The drive mechanism 50 includes an electric motor 54, a transmission 56, and a drive shaft 58. The transmission connects the motor 54 and the drive shaft 58 such that operation of the motor 54 rotates the drive shaft 58 in the clockwise and counterclockwise directions. The drum assembly 52 is coupled to the drive shaft 58, such that rotation of the drive shaft 58 by the motor 54 rotates the drum assembly 52 in the clockwise and counterclockwise directions. In the illustrated embodiment, the drum 52 and the drive shaft 58 move axially along the longitudinal axis 30 of the base 12, the purpose of which will discussed in more detail below.

Figure 4:
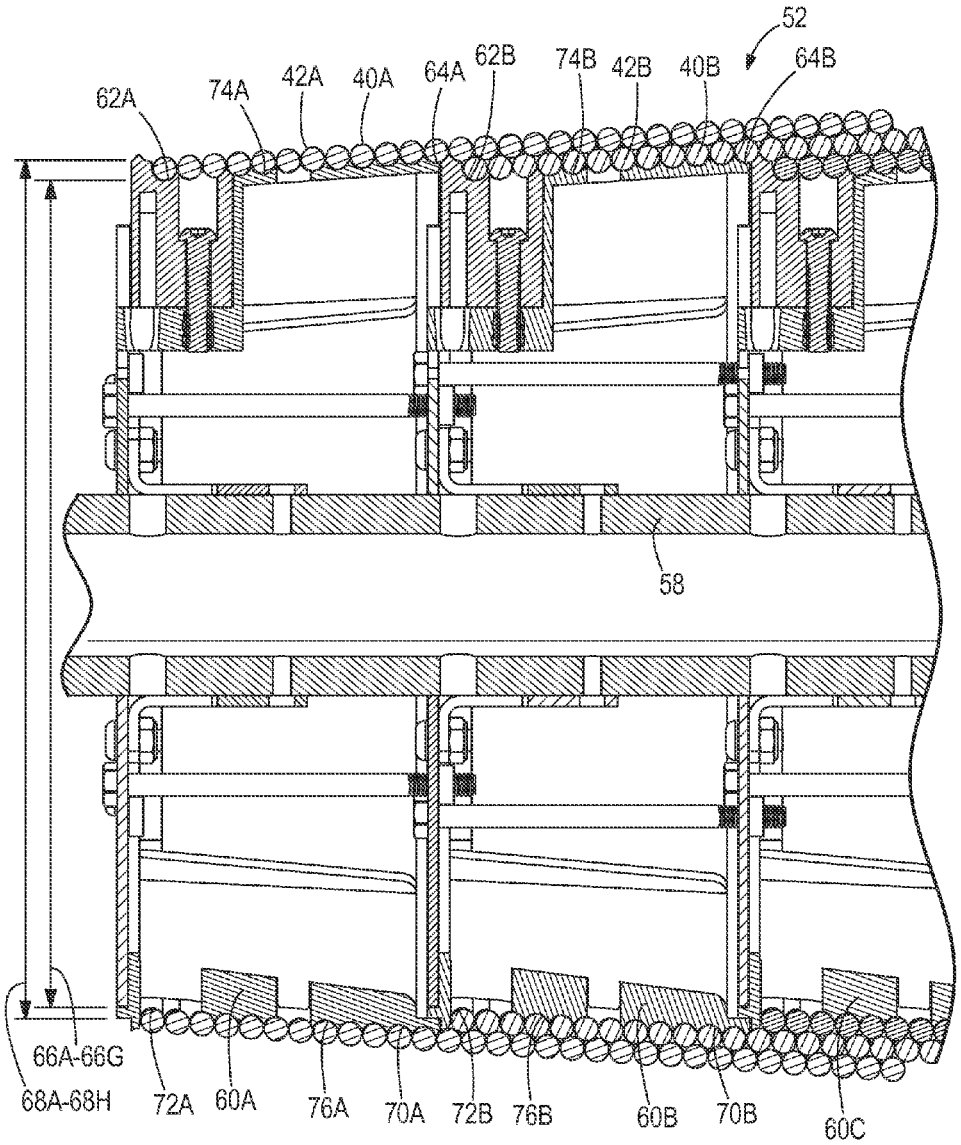
FIG. 4 is an enlarged view of a portion of FIG. 3

Referring to FIGS. 3 and 4, the drum assembly 52 includes drum segments 60A-60H. The drum segments 60A-60H correspond to the flexible drive elements 40A-40H. That is, the flexible drive element 40A winds around drum segment 60A, the flexible drive element 40B winds around drum segment 60B, etc. The drum segments 60A-60H are substantially the same and like components have been given like reference numbers with the suffix A-H, which corresponds to the drum segments 60A-60H. The drum segment 60A includes a first end 62A and a second end 64A. The first end 62A has a diameter 66A and the second end 64A has a diameter 68A that is larger than the diameter 66A. The diameter of the drum segment 60A constantly increases from the first end 62A to the second end 64A. Therefore, a large diameter portion 70A of the drum segment 60A is located adjacent the second end 64A, a small diameter portion 72A is located adjacent the first end 62A, and a tapered portion 74A is located between the small diameter portion 72A and the large diameter portion 70A.

The drum segments 60A-60H are coupled to the drive shaft 58 as best seen in FIG. 3. The first end 62B of the second drum segment 60B having the small diameter 66B abuts the second end 64A of the first drum segment 60A having the large diameter 68A. Likewise, the first end 62C of the third drum segment 60C having the small diameter 66B abuts the second end 64B of the second drum segment 60B having the large diameter 68B. The remainder of the drum segments 60D-60H are similarly arranged along the drive shaft 58.

The drum segments 60A-60H all includes grooves 76A-76H, respectively, that extend circumferentially around the drum segments 60A-60H. The grooves 76A-76H receive the respective flexible drive elements 40A-40H to facilitate winding the flexible drive elements 40A-40H around the drum assembly 52.

Referring to FIG. 2, the lift assembly further includes internal sheaves 80A-80H. The internal sheave 80A corresponds to the drum segment 60A and the flexible drive element 40A, the internal sheave 80B corresponds to the drum segment 60B and the flexible drive element 40B, etc.

The sheaves 80A-80H direct the corresponding flexible drive element 40A-40H from the corresponding drum segment 60A-60H to the outlet 34. A head block 82 is located adjacent the outlet 34. The head block 82 includes a plurality of rollers 84 that guide the flexible drive elements 40A-40H. In the illustrated embodiment, the internal sheaves 80A-80H can be configured to route the flexible drive elements 80A-80H through the first outlet 34 and the second outlet 36. When any of the flexible drive elements 80A-80H are routed through the second outlet 36 a second head block, similar to head block 82, would be located adjacent the second outlet 36.

With continued reference to FIG. 2, the illustrated lift assembly 10 includes a threaded rod 92 located at an end of the shaft 58. The rod 92 is fixed relative to the frame 18. The shaft 58 is generally hollow and the threaded rob 92 is received in a threaded recess of the shaft 58. As the shaft 58 rotates relative to the rod 92 (which is fixed relative to the frame 18) the shaft 58 and drum assembly 52 (which is fixed relative to the shaft 58) move relative to the internal sheaves 80A-80H along the longitudinal axis 30 to facilitate winding and unwinding the flexible drive elements 40A-40H around the drum assembly 52.

In operation, the motor 54 rotates the drive shaft 58 to wind and unwind the flexible drive elements 40A-40H around the drum assembly 52 to raise and lower the free portions 44A-44H of the flexible drive elements 40A-40H, which raises and lowers an article, such as scenery, props, lighting, and the like that are attached to the free portions 44A-44H. As best seen in FIG. 3, when raising the article, the flexible drive elements 40A-40H wrap around the corresponding drum segment 60A-60H in the corresponding grooves 76A-76H. The first flexible drive element 40A starts wrapping around the segment 60A in the grooves 76A in the small diameter portion 72A of the segment 60A. Meanwhile, the second flexible drive element 40B starts wrapping around the drum segment 60B in the grooves 76B in the small diameter portion 72B of the drum segment 60B. The additional flexible drive elements 40C-40H likewise wrap around the corresponding drum segments 60C-60H.

The flexible drive element 40B is wrapped onto the small diameter portion 72B of the drum segment 60B to define an outer profile or outer diameter that is substantially flush with the large diameter portion 70A of the drum segment 60A. As the flexible drive element 40A continues to wind onto the drum segment 60A, the additional stored portion 42A moves in a direction toward the drum segment 60B because the drum assembly 52 moves relative to the frame 18 along the longitudinal axis 30. Eventually, the flexible drive element 40A wraps around the drum segment 60A until it reaches the second end 64A of the drum segment 60A, and as the flexible drive element 40A continues to wind around the drum assembly 52, the flexible drive element 40A overlaps onto the outer profile created by the flexible drive element 40B. As discussed above, the outer profile of the drive element 40B is flush with the second end 64A of the drum segment 60A, and therefore the drive element 40A smoothly transitions from wrapping around the segment 60A and onto the segment 60B. As illustrated in FIG. 3, the other flexible drive elements 40B-40G similarly overlap onto the adjacent drum segment 60B-60G. Because segment 60H is the final drum segment there is no adjacent segment for drive element 40H to wrap onto and around. Therefore, drum segment 60H is longer and has a longer tapered portion 74H than the other drum segments 60A-60G.

Figure 6:
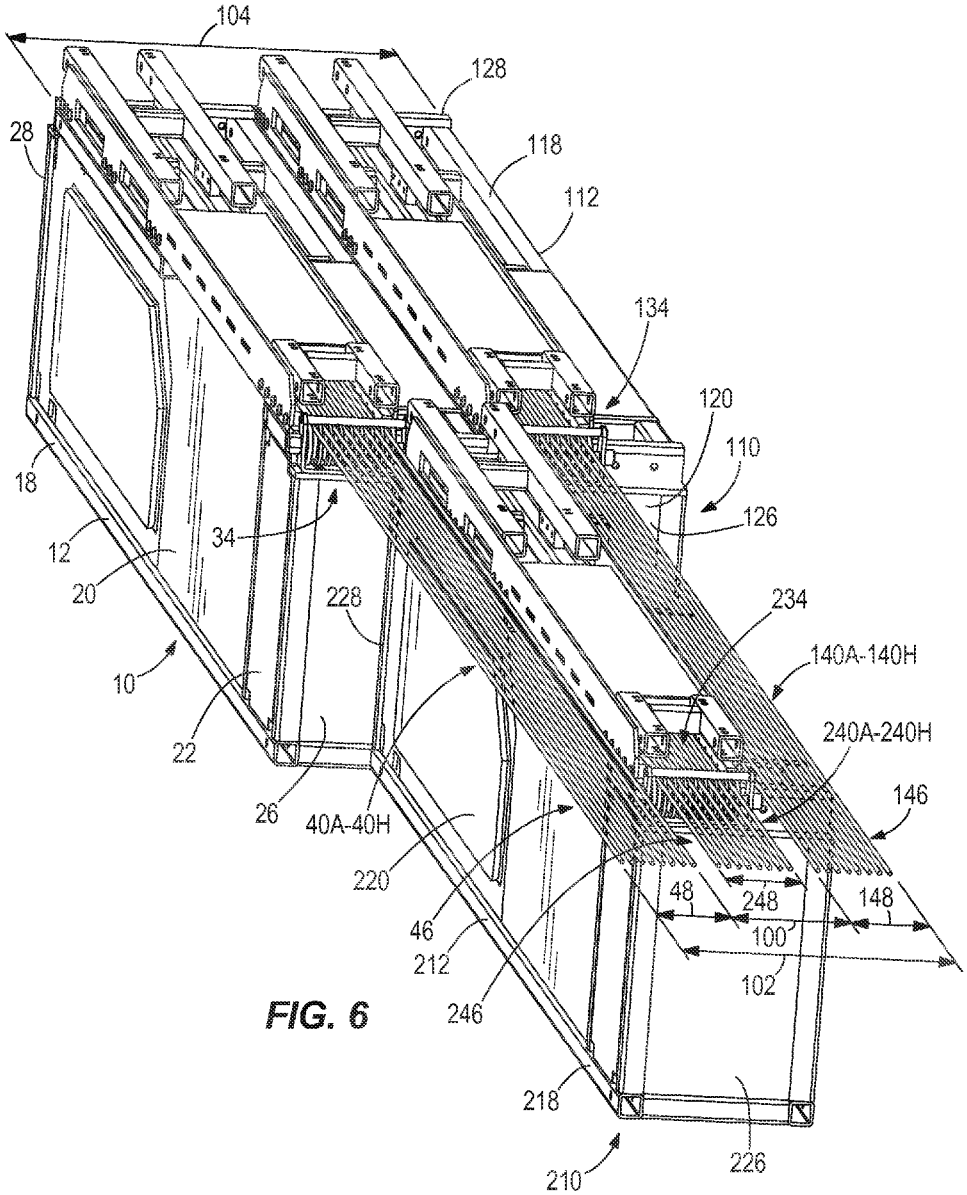
FIG. 6 is a perspective view of multiple lift assemblies of FIG. 1 in a nested configuration according to another embodiment of the invention.
Figure 7:
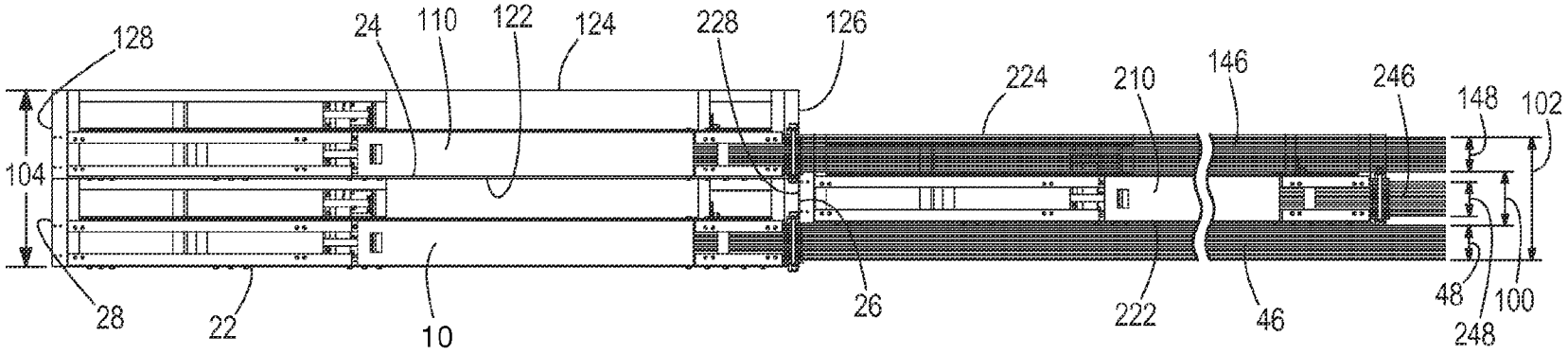
FIG. 7 is a top view of the nested lift assemblies of FIG. 4.
Figure 8:
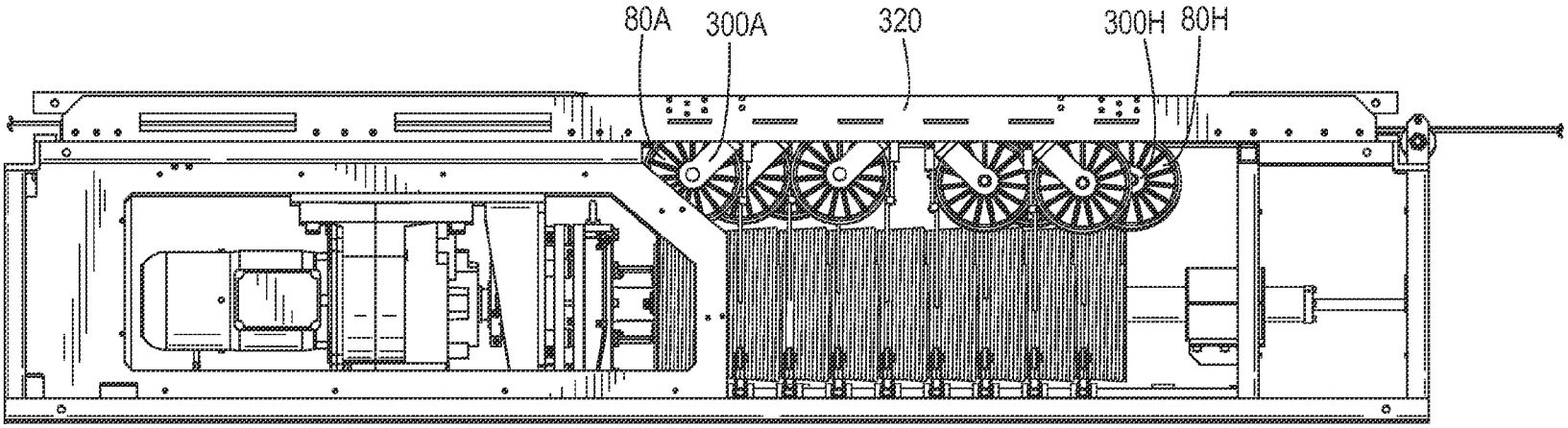
FIG. 8 is a side view of a second embodiment of a lift assembly embodying aspects of the present invention with a side panel removed.
Figure 9:
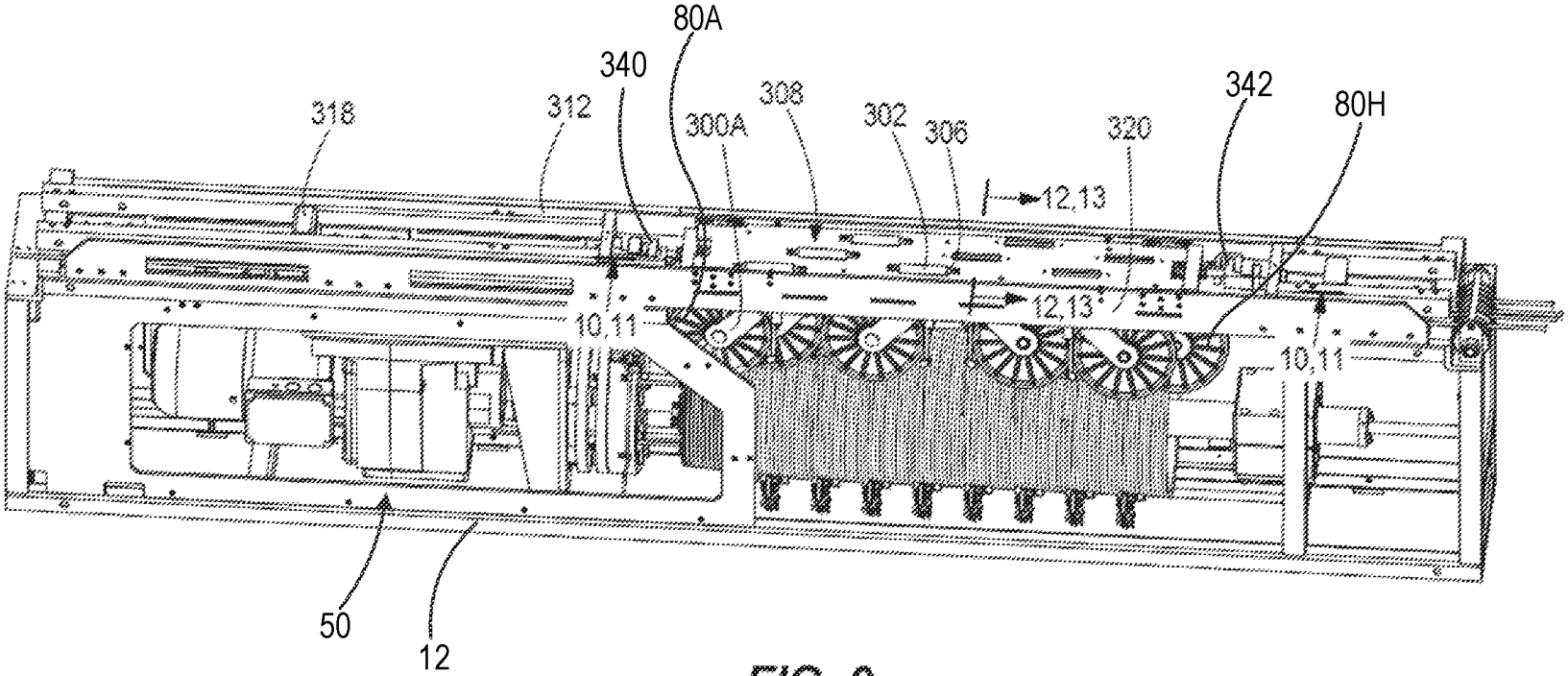
FIG. 9 is a perspective view of the lift assembly of FIG. 8.
Figure 10:
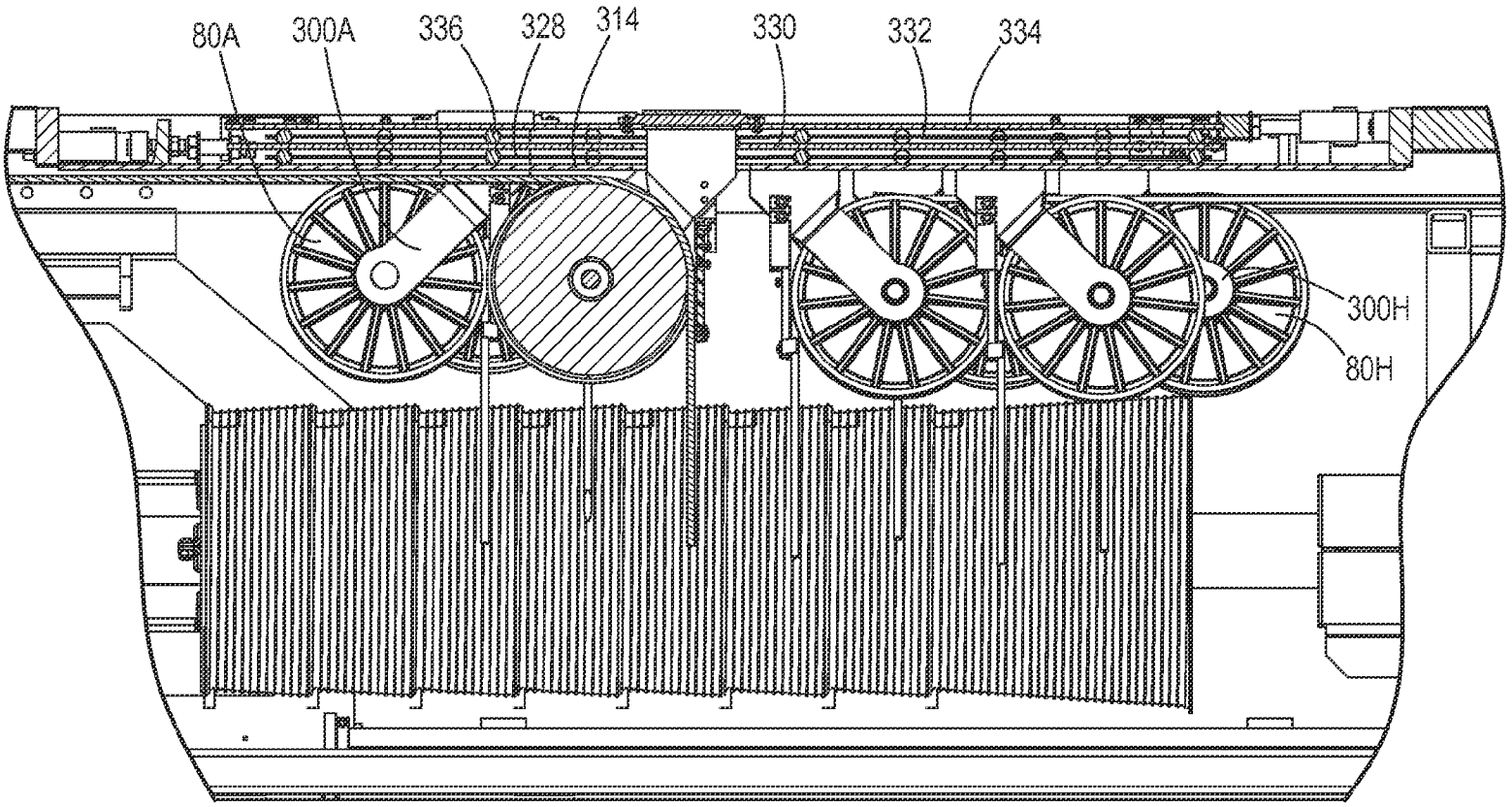
FIG. 10 is an enlarged side view of a portion of the lift assembly of FIG. 8.
Figure 11:
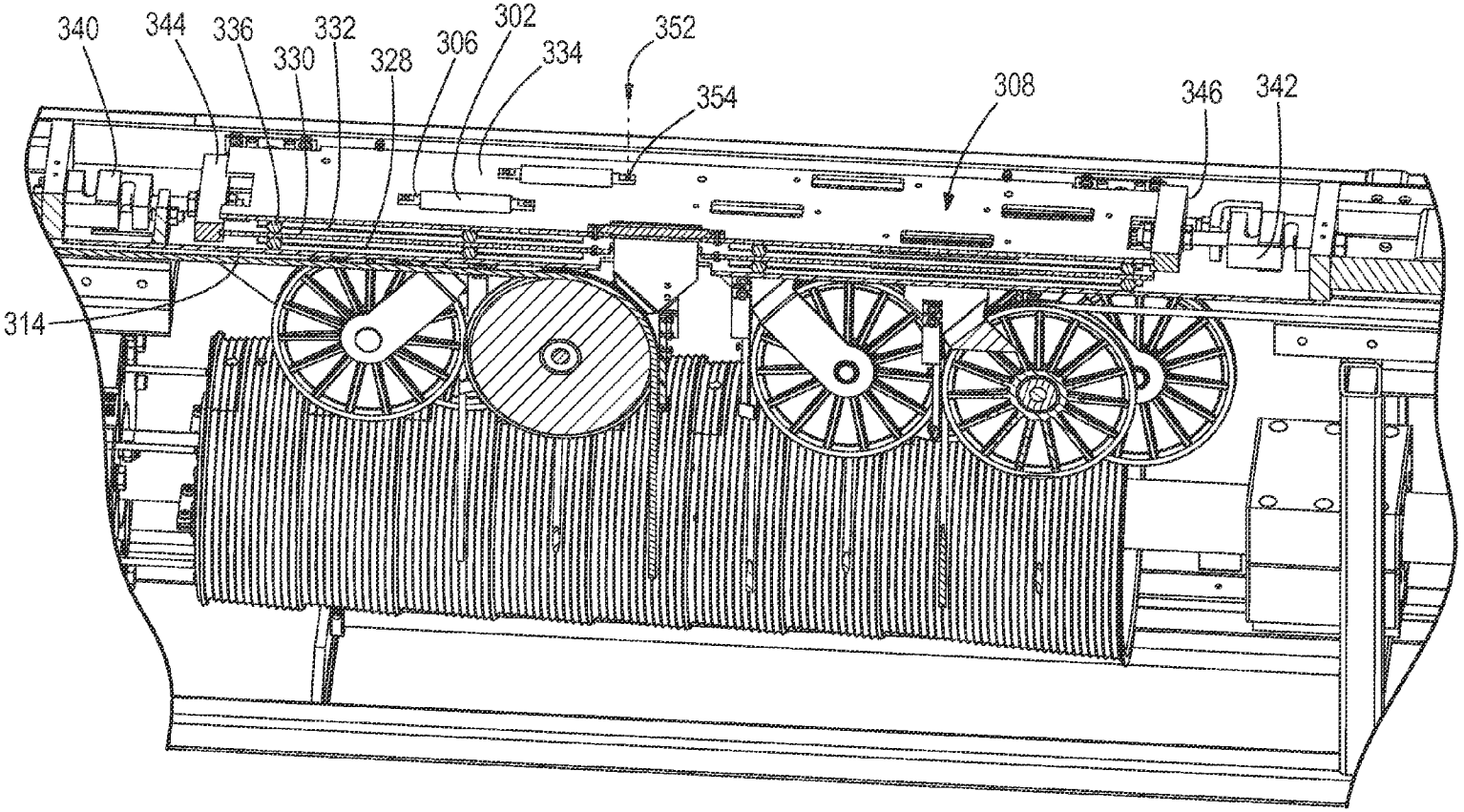
FIG. 11 is an enlarged perspective view of the portion of the lift assembly of FIG. 10.
Figure 12:
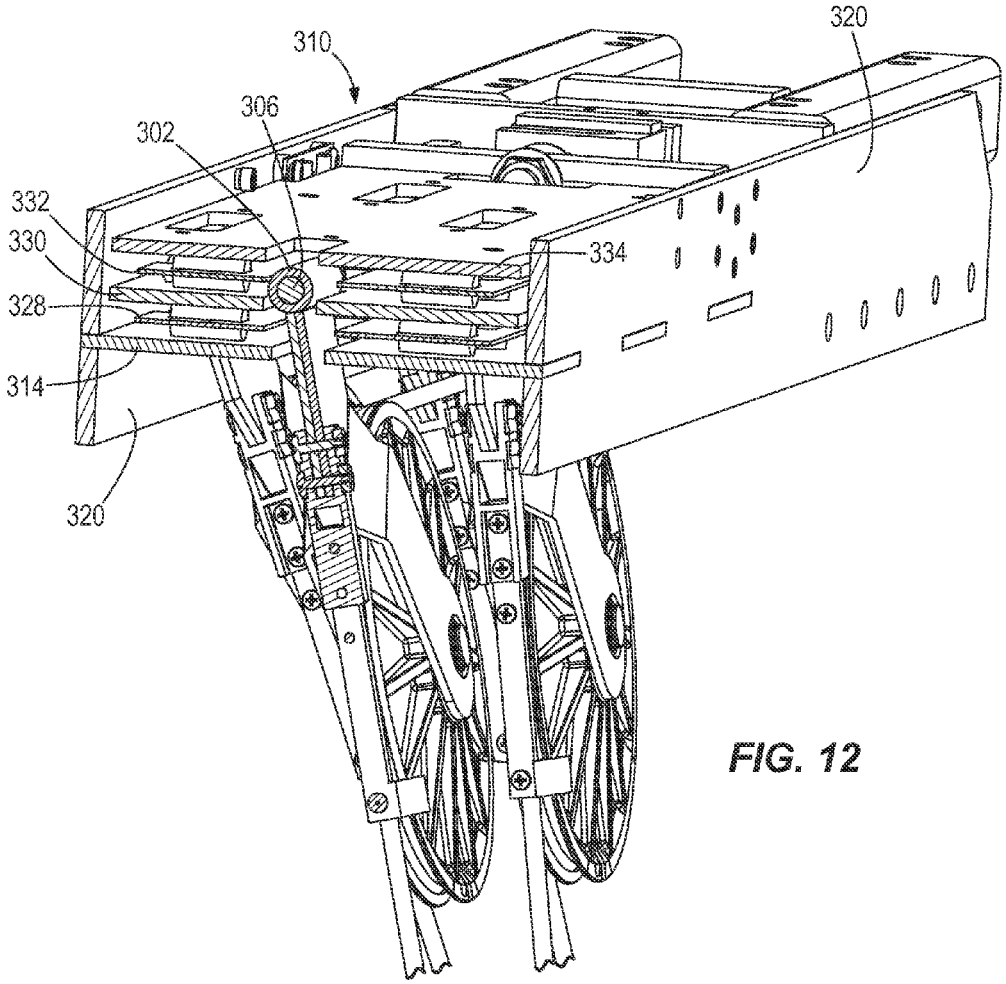
FIG. 12 is a perspective view taken in section along line 12-12 in FIG. 9.
Figure 13:
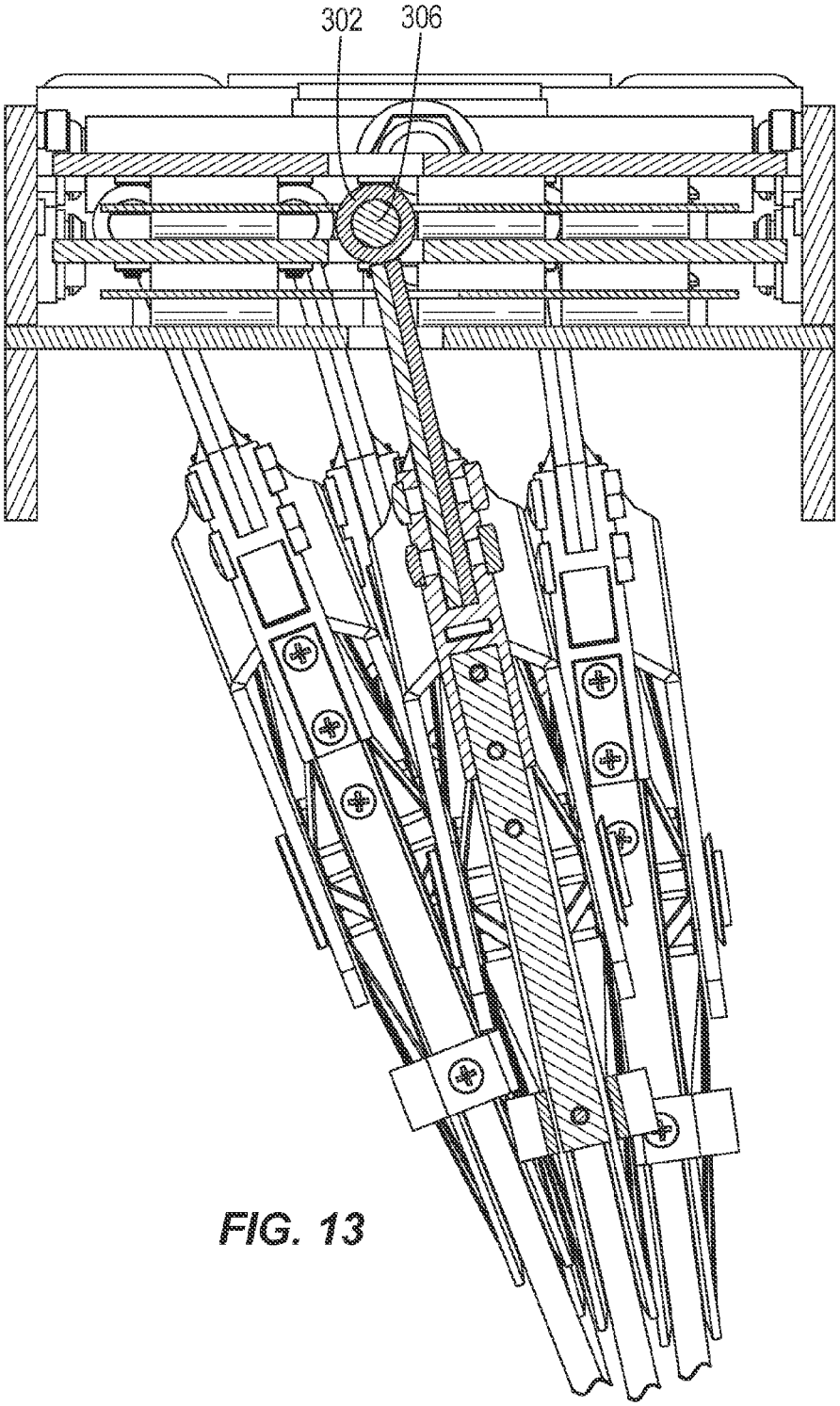
FIG. 13 is an end view of the section view of FIG. 12.
Figure 14:
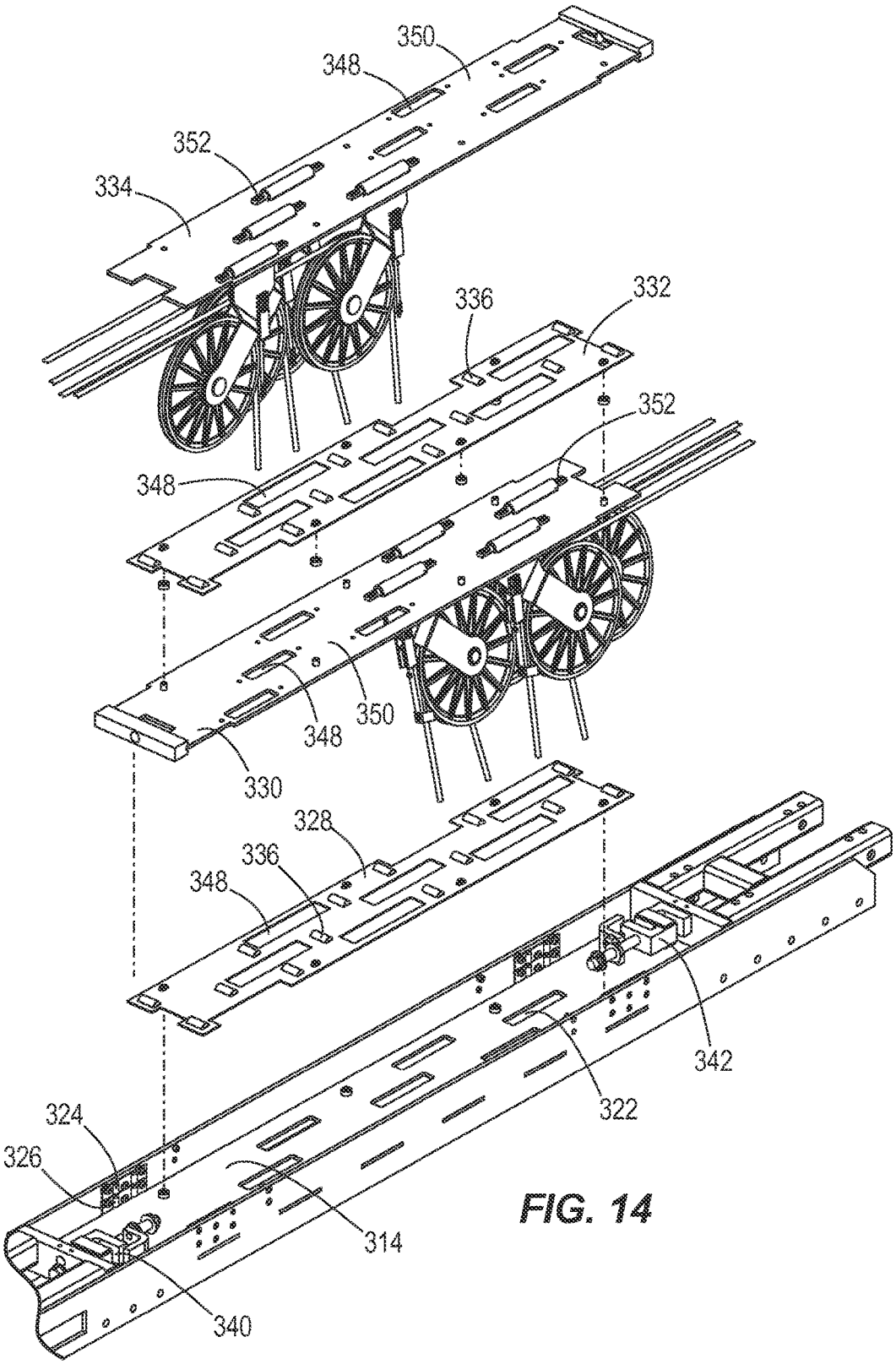
FIG. 14 is an exploded perspective view of the lift assembly of FIG. 8.
Figure 15:
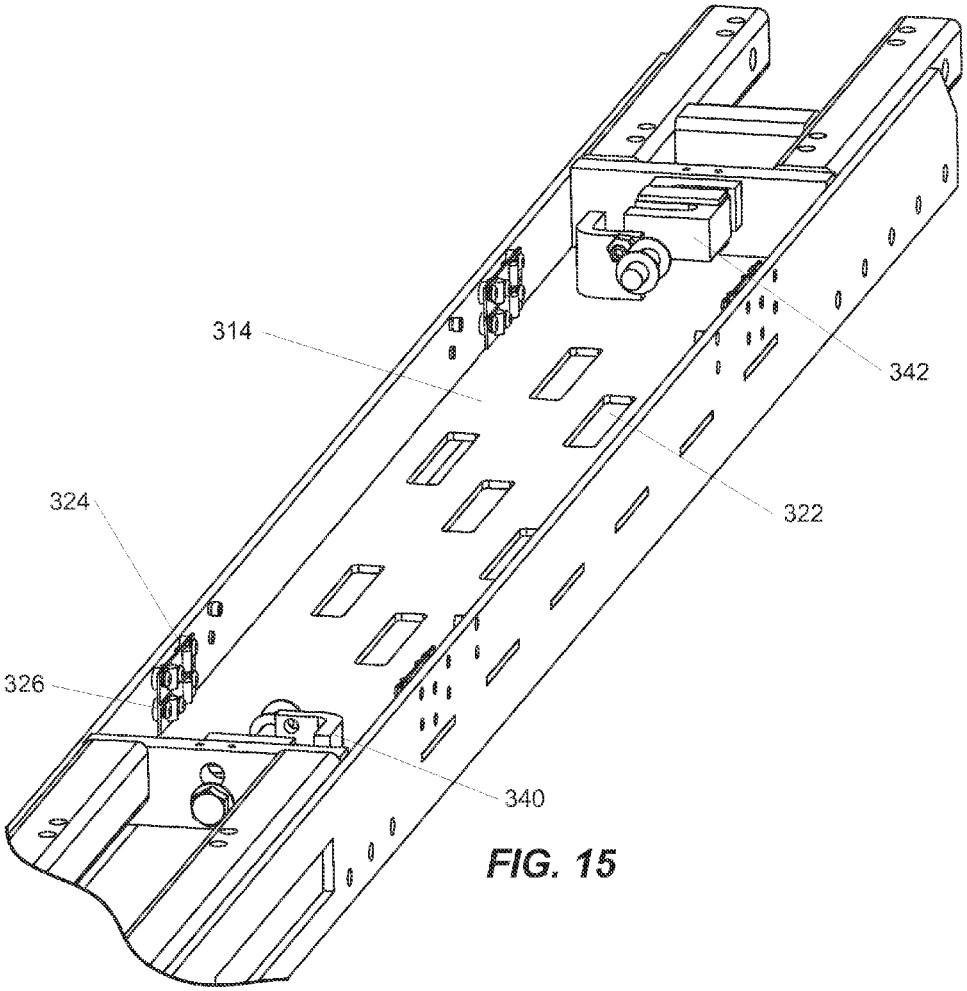
FIG. 15 is an enlarged perspective view of a portion of the lift assembly of FIG. 14.

As illustrated in FIGS. 6 and 7, multiple lift assemblies 10, 110, and 210 can be mounted adjacent to each other and together the lift assemblies 10, 110, 210 can be mounted to a structure, such as a ceiling, a floor, walls, or other suitably stable component. Each of the illustrated lift assemblies 10, 110, and 210 is structurally identical to the other lift assemblies 10, 110, and 210 and identical to the lift assembly 10 described above with regard to FIGS. 1-3 and therefore like components have been given like reference numbers plus 100. Each has lift assembly 10, 110, and 210 has its own position or orientation, as described below in more detail.

With continued reference to FIGS. 6 and 7, the second side 24 of the first lift assembly 10 is positioned adjacent the first side 122 of the second lift assembly 110. In the illustrated embodiment, the second side 24 of the lift assembly 10 abuts the first side 122 of the lift assembly 110. Also, the ends 26, 126 and 28, 128 are aligned and flush as illustrated. Therefore, the cable path 46 and the cable path 146 extend in the same direction and are parallel. As illustrated in FIGS. 6 and 7, the cable path 46 exiting the base 12 of the first lift assembly 10 is spaced a distance 100 from the cable path 146 exiting the base 112 of the second lift assembly 110.

The second end 228 of the base 212 of the third lift assembly 210 abuts the first end 26 of the first lift assembly 10 and the first end 126 of the second lift assembly 110 to define a pyramid arrangement with the third lift assembly 210 forming a peak of the pyramid. The third lift assembly 210 is positioned so that the cable path 246 is between in the cable paths 46, 146 and located in the space 100. The cable path 246 extends in the same direction as the cable paths 46, 146 and parallel to the paths 46, 146 and the cable paths 46, 146, 246 are co-planar. Together the cable paths 46, 146, 246 define a total cable path width 102. In the illustrated embodiment that includes three lift assemblies 10, 110, 210, the total cable path width 102 is only about 3.6 times greater than the width 48 of a single cable path 48, 148, 248. In other embodiments, the total cable path width is between about 3.3 to 3.9 times greater than the width of a single cable path. In yet other embodiments, the total cable path width is between about 3.1 to 4.1 times greater than the width of a single cable path.

The base 12 of the first lift assembly 10 and the base 112 of the second lift assembly 110 are side-by-side to define a total width 104 (FIG. 7) of the group of lift assemblies 10, 110, and 210. The total cable path width 102 is less than the width 104 of the group of lift assemblies 10, 110, 210. In some embodiments, the total cable path width 102 is less than 80 percent of the width 104, and in yet other embodiments, the total cable path width 102 is less than 95 percent of the width 104.

The first, second, and third lift assemblies 10, 110, 210 can be coupled using any suitable fastener or method such as bolts, welding, and the like. Also, although the illustrated third lift assembly 210 abuts both ends 26, 126 of the lift assemblies 10, 110, respectively, in other embodiments, the end 226 of the third lift assembly 210 may abut only one of the ends 26, 126.

The nested arrangement of the lift assemblies 10, 110, 210, described above, reduces the total cable path width 102 (compared to positioning the three lift assemblies In a side-by-side orientation). Reducing the total cable path width 102 is desirable because it reduces the distance required between articles lifted by the lift assemblies 10, 110, 210. Or, if the lift assemblies 10, 110, 210 are lifting the same article, the distance between all the flexible drive elements 40, 140, 240 is reduced, which reduces the horizontal spacing required between any loft blocks that redirect the flexible drive elements 40, 140, 240 down to the article being raised and lowered.

Referring to FIGS. 8-15, the sheaves 80A-H are supported by sheave brackets 300A-H, respectively. Each sheave bracket 300 includes a sheave pivot 302 having an opening through which a sheave pin 306 can be positioned to allow the sheave bracket 300 to rotate relative to the sheave pin 306. The sheave pins 306 are each secured to a load plate assembly 308, as described below in more detail.

The load plate assembly 308 rests in a pocket 310 formed in an upper frame 312 that is part of the frame 18. The upper frame 312 includes a bottom plate 314, two longitudinal members 316, two cross members 318, and two side rails 320 secured to opposing outer surfaces of the longitudinal members 316. The bottom plate 314 includes openings 322 through which the sheave brackets 300 are positioned. The side rails 320 include upper and lower side bearings 324,326 (e.g., roller bearings, FIGS. 14-15), the function of which are described below.

The load plate assembly 308 includes a lower bearing plate 328 positioned on the bottom plate 314, a lower sheave plate 330 positioned on the lower bearing plate 328, an upper bearing plate 332 positioned on the lower sheave plate 330, and an upper sheave plate 334 positioned on the upper bearing plate 332. In this manner, it can be seen that the lower sheave plate 328 is positioned directly below the upper sheave plate 332. The upper and lower bearing plates 332,328 each includes roller bearings 336 positioned under each plate to facilitate longitudinal movement of the upper and lower sheave plates 334,330 relative to the upper frame 312. The upper and lower side bearings 324,326 reduce friction between the upper and lower sheave plates 334,330 and the upper frame 312.

The load plate assembly 308 further includes upper and lower load cells 340,342 and upper and lower end caps 344,346 sandwiched between the upper and lower sheave plates 334,330 and the upper and lower load cells 340,342, respectively. In this manner, the upper load cell 340 senses a horizontal load to the right (in the Figures) on the upper sheave plate 334, and the lower load cell 342 senses a horizontal load to the left (in the Figures) on the lower sheave plate 330.

Each of the upper and lower bearing plates 332,328 and upper and lower sheave plates 334,330 includes openings 348 through which the upper portion of corresponding sheave brackets 300 can be inserted. For example, when a sheave bracket 300 is secured to the upper shave plate 334, an upper end of the sheave bracket 300 will protrude through the opening 348 in the upper shave plate (see, e.g., FIGS. 14 and 16) and a middle portion of the shave bracket 300 will be positioned in the aligned openings 340 of the upper and lower bearing plates 332,328 and the lower sheave plate 330.

Adjacent each opening 348 in the upper and lower sheave plates 334,330 there is provided a sheave mount (e.g., threaded holes 350 in the sheave plate 330,334 spaced from the corresponding opening 348) that facilitates the securing of one of the sheave pins 306. In the illustrated embodiment, the sheave mount further includes bolts 352 inserted through orifices 354 in the ends of each sheave pin 306 and threaded into the corresponding threaded holes 350 in the corresponding sheave plate 334,330 to secure the sheave brackets 300 to one of the sheave plates.

Each sheave bracket 300 can be secured to either the upper sheave plate 334 or the lower sheave plate 330, depending on which direction the corresponding cable is directed. In the illustrated embodiment, four sheaves are mounted to each of the upper and lower sheave plates 334,330. In particular, sheaves 80E-H that direct cables 40E-H to the right are mounted to the upper sheave plate 334, and sheaves 80A-D that direct cables 40A-D to the left are mounted to the lower sheave plate 330. Even though each sheave plate 334,330 is only supporting four sheave brackets 300, each of the illustrated sheave plates 334,330 includes eight sheave mounts (threaded holes 350 in the sheave plates 334, 330) that are aligned vertically with the eight sheave mounts of the other sheave plate 334,330. In this regard, each of the sheave brackets 300 can be mounted to either the upper sheave plate 334 or the lower sheave plate 330. When switching a particular sheave bracket 300 from one sheave plate to the other, the sheave bracket 300 is rotated 180 degrees about a vertical axis so that the corresponding sheave 80 is positioned to direct the corresponding cable 40 in the opposite direction.

Figure 16:
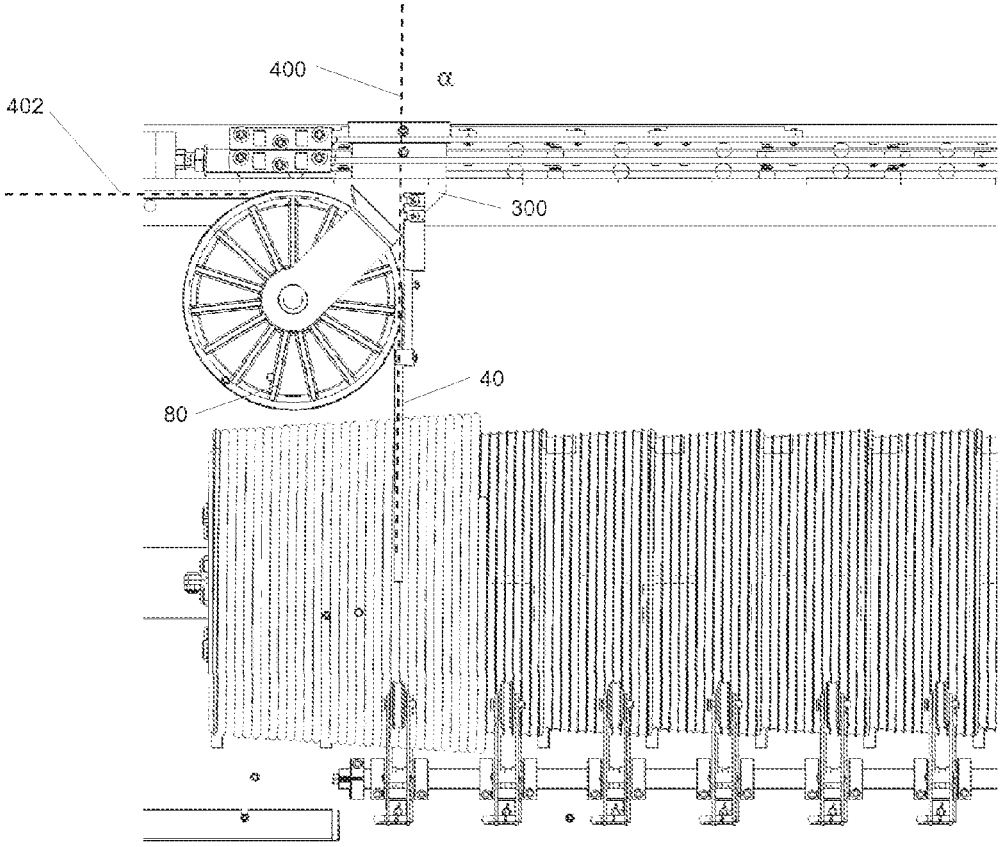
FIG. 16 is a side view of the lift assembly with emphasis on one sheave in a first position.
Figure 17:
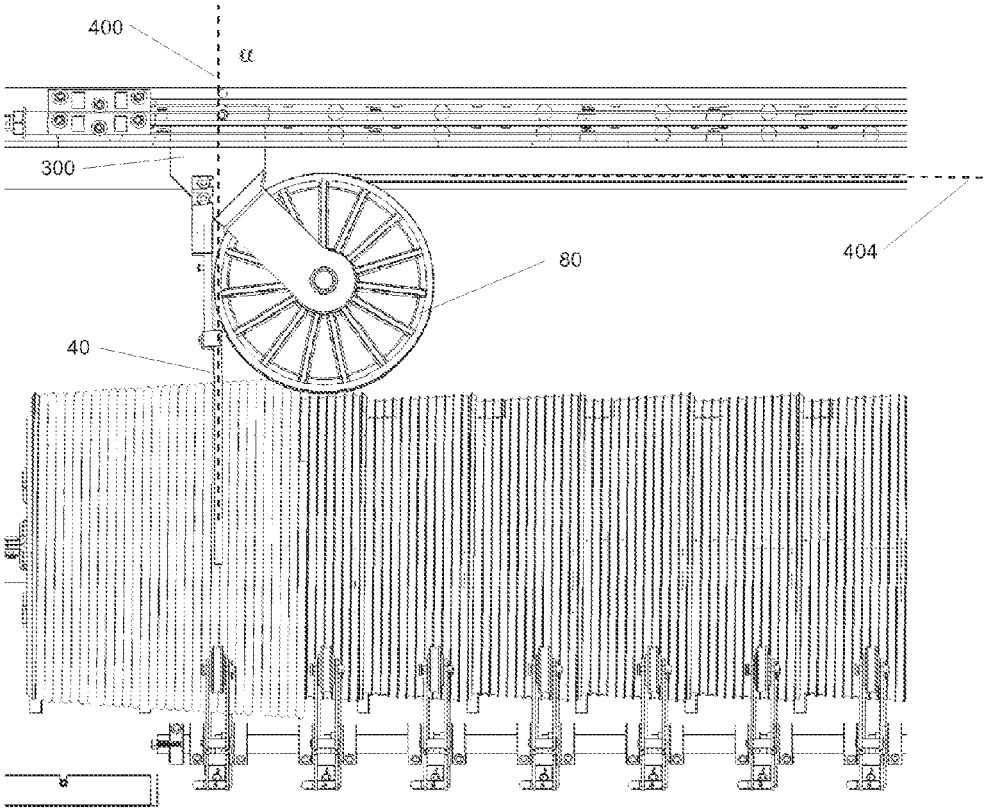
FIG. 17 is the side view of FIG. 16 with the sheave rotated to a second position.

Referring to FIGS. 16-17, the mounting of each sheave 80 is substantially symmetrical relative to a near edge of the sheave 80. In other words, rotating a sheave bracket 300 180 degrees (compare FIG. 16 to FIG. 17) in order to facilitate mounting the sheave 80 to the other sheave plate does not substantially change the position of the corresponding cable 40 extending from the sheave 80 to the corresponding drum segment (not visible in FIGS. 16-17 because the corresponding drum segment is covered with the cable 40). In other words, when the sheave 80 is mounted on the upper sheave plate 334, it is in a first orientation (FIG. 16) in which the sheave 80 receives the cable 40 from the drum along a fleet axis 400 at a fleet angle $\alpha$ (angle between the fleet axis 400 and the axis of rotation of the drum, when view from the side, as shown in FIG. 16) and redirects the cable 40 to an output axis 402. When the sheave 80 is mounted on the lower sheave plate 330, it is in a second orientation (FIG. 17) in which the sheave 80 receives the cable 40 substantially along the same fleet axis 400 at substantially the same fleet angle $\alpha$ and redirects it to a different output axis 404. This feature allows a sheave 80 to direct a cable 40 in either direction without substantially changing the position of the cable 40 relative to the drum segment 60.

The upper and lower load cells 340,342 are coupled to a processor that determines the horizontal load on each of the upper and lower sheave plates 334,330. These loads can be summed and/or individually monitored for a given loading arrangement in order to sense deviations from a standard or expected load profile.

Various features and advantages of the invention are set forth in the following claims.

What is claimed is:

1. A lift assembly comprising:

a base;

a drive mechanism;

first and second flexible drive elements driven by the drive mechanism;

first and second sheaves directing the first and second drive elements, respectively, along paths in first and second directions, respectively; and a first load cell for sensing a first load on the first sheave in the first direction and a second load cell for sensing a second load on the second sheave in the second direction;

wherein the first and second sheaves are mounted to first and second sheave mounts, respectively, and wherein the first and second load cells sense load on the first and second sheave mounts, respectively;

wherein the first and second sheave mounts are provided on first and second sheave plates, respectively; wherein the first sheave plate is positioned at least partially directly below the second sheave plate.

2. A lift assembly as claimed in claim 1, further comprising first and second bearings positioned under the first and second sheave plates, respectively.

3. A lift assembly as claimed in claim 1, further comprising side bearings positioned between the sheave plates and the base.

4. A lift assembly as claimed in claim 1, further comprising first and second sheave brackets for coupling the first and second sheaves to the first and second sheave mounts, wherein the first sheave plate includes an opening, and wherein at least a portion of the second sheave bracket is positioned in the opening.

5. A lift assembly as claimed in claim 4, wherein the first sheave plate includes a third sheave mount adjacent the opening and substantially below the second sheave mount and configured to allow mounting of the second sheave to the first sheave plate.

6. A lift assembly as claimed in claim 4, wherein the second sheave plate includes a third sheave mount directly above the first sheave mount and configured to allow mounting of the first sheave to the second sheave plate.

7. A lift assembly as claimed in claim 1, wherein the first and second sheave mounts are each movable relative to the base.

8. A lift assembly comprising:

a base;

a drive mechanism;

first and second flexible drive elements driven by the drive mechanism;

first and second sheaves directing the first and second drive elements, respectively, along paths in first and second directions, respectively; and a first load cell for sensing a first load on the first sheave in the first direction and a second load cell for sensing a second load on the second sheave in the second direction;

wherein the first and second sheaves are mounted to first and second sheave mounts, respectively, and wherein the first and second sheave mounts are provided on first and second sheave plates, respectively; and wherein the first sheave plate is positioned at least partially directly below the second sheave plate; and wherein the lift assembly further comprises first and second sheave brackets for coupling the first and second sheaves to the first and second sheave mounts, wherein the first sheave plate includes an opening, and wherein at least a portion of the second sheave bracket is positioned in the opening.

9. A lift assembly as claimed in claim 8, wherein the first and second load cells sense load on the first and second sheave plates, respectively.

10. A lift assembly as claimed in claim 8, further comprising first and second bearings positioned under the first and second sheave plates, respectively.

11. A lift assembly as claimed in claim 8, further comprising side bearings positioned between the sheave plates and the base.

12. A lift assembly as claimed in claim 8, wherein the first sheave plate includes a third sheave mount adjacent the opening and substantially below the second sheave mount and configured to allow mounting of the second sheave to the first sheave plate.

13. A lift assembly as claimed in claim 8, wherein the second sheave plate includes a third sheave mount directly above the first sheave mount and configured to allow mounting of the first sheave to the second sheave plate.

14. A lift assembly as claimed in claim 8, wherein the first and second sheave mounts are each movable relative to the base.

15. A lift assembly as claimed in claim 8, wherein the first and second sheave plates are movable relative to the base.

16. A lift assembly as claimed in claim 8, wherein the first sheave bracket is movable relative to the first sheave plate, and wherein the second sheave bracket is movable relative to the second sheave plate.

17. A lift assembly as claimed in claim 1, wherein the first and second sheave plates are movable relative to the base.

18. A lift assembly as claimed in claim 4, wherein the first sheave bracket is movable relative to the first sheave plate, and wherein the second sheave bracket is movable relative to the second sheave plate.

* * * * *